US011415916B1

(12) United States Patent
Ishii

(10) Patent No.: US 11,415,916 B1
(45) Date of Patent: Aug. 16, 2022

(54) IMAGE FORMING APPARATUS WITH IMAGE FORMER AND FUSER

(71) Applicant: TOSHIBA TEC KABUSHIKI KAISHA, Tokyo (JP)

(72) Inventor: Hiroshi Ishii, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/208,352

(22) Filed: Mar. 22, 2021

(51) Int. Cl.
*G03G 15/20* (2006.01)

(52) U.S. Cl.
CPC ..... *G03G 15/205* (2013.01); *G03G 15/2039* (2013.01); *G03G 15/201* (2013.01); *G03G 15/2046* (2013.01); *G03G 15/2053* (2013.01)

(58) Field of Classification Search
CPC ..... G03G 15/205; G03G 15/2039
USPC ..... 399/70; 219/216
See application file for complete search history.

(56) References Cited

U.S. PATENT DOCUMENTS

2002/0116144 A1 8/2002 Yamauchi et al.
2004/0033084 A1 2/2004 Akizuki et al.
2007/0047991 A1* 3/2007 Itoh ..... G03G 15/2064 399/69
2009/0238597 A1* 9/2009 Cao ..... G03G 15/2039 399/70
2009/0297199 A1 12/2009 Yamashina et al.
2011/0262159 A1 10/2011 Takeuchi et al.
2011/0293309 A1 12/2011 Hase
2013/0251390 A1* 9/2013 Ishii ..... G03G 15/205 399/67
2014/0079425 A1* 3/2014 Tanaka ..... G03G 15/205 399/70
2014/0153948 A1* 6/2014 Koyama ..... G03G 15/205 399/69
2015/0220029 A1 8/2015 Samei et al.

FOREIGN PATENT DOCUMENTS

JP 2004-070041 3/2004
JP 2012-252258 12/2012
JP 2014-002191 1/2014

* cited by examiner

*Primary Examiner* — Robert B Beatty
(74) *Attorney, Agent, or Firm* — Foley & Lardner LLP

(57) ABSTRACT

An image forming apparatus includes an image former, a fuser, a first sensor, and a processor. The image former is configured to form an image on a recording medium. The fuser is configured to fix the image on the recording medium. The first sensor is configured to detect a temperature of the fuser. The processor is configured to cause the recording medium to be supplied to the fuser after warming up the fuser to a warm up temperature. The processor is also configured to supply power to the fuser after causing the recording medium to be supplied to the fuser, an amount of the supplied power being based on the temperature detected before starting the warming up.

19 Claims, 7 Drawing Sheets

IMAGE FORMING APPARATUS WITH IMAGE FORMER AND FUSER

FIELD

Embodiments described herein relate generally to an image forming apparatus.

BACKGROUND

In the related art, there is an image forming apparatus using an induction heating type fuser having a low heat capacity in order to support energy saving in a medium-speed, high-speed machine. In such an image forming apparatus, a control temperature or a heat storage before printing of the image forming apparatus is set according to an operating environment, a type of a print medium, or a temperature state of the image forming apparatus before printing. However, with a simple setting, it is not possible to supply required power to the fuser or set the fuser to a required heat storage state when the image forming apparatus is cold or when the image forming apparatus is warm. Due to high or low temperature of the fuser, image defects are likely to occur in a few sheets immediately after the start of the printing.

DETAILED DESCRIPTION

According to one embodiment, an image forming apparatus includes a fuser, a sensor, and a control circuit. The sensor detects temperature of the fuser. The control circuit changes (varies) the control of power supplied to the fuser after the start of supply of a medium to the fuser based on the temperature before warming up the fuser (before the fuser reaches a warm up temperature of the fuser). Hereinafter, embodiments will be described with reference to the drawings.

The image forming apparatus according to the embodiment is an apparatus having an electrophotographic printing function. In the embodiment, the image forming apparatus will be described as being a digital multifunction device (e.g., a Multifunction Peripheral (MFP)) having a copy function, a print function, a facsimile function, a scanner function, and the like.

[Configuration of Apparatus]

Figure 1:
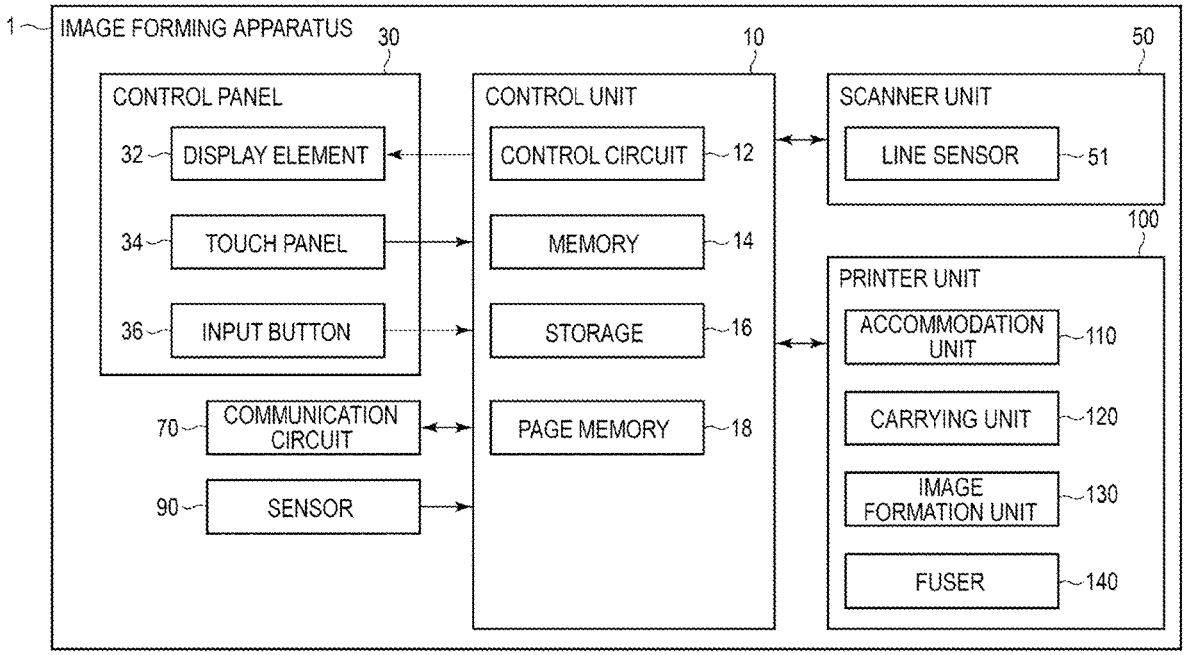
FIG. 1 is a block diagram illustrating an outline of an example configuration of an image forming apparatus according to an embodiment.

FIG. 1 is a block diagram illustrating an outline of an example configuration of the image forming apparatus 1 according to the embodiment.

As illustrated in FIG. 1, the image forming apparatus 1 includes a control unit 10 (controller), a control panel 30, a scanner unit 50 (scanner), a communication circuit 70 (communicator), a sensor 90, and a printer unit 100 (printer).

The control unit 10 controls an operation of each unit of the image forming apparatus 1. The control unit 10 includes a control circuit (processor), a memory 14 (first memory), a storage 16 (second memory), and a page memory 18 (third memory).

The control circuit 12 includes, for example, a processor, such as a central processing unit (CPU). The control circuit 12 may include an application specific integrated circuit (ASIC), a field programmable gate array (FPGA), a graphics processing unit (GPU), or the like, in addition to or in place of the CPU.

The memory 14 may include a read only memory (ROM) and a random access memory (RAM). The ROM records, for example, a startup program or the like. The RAM functions, for example, as a main storage device of the CPU.

The storage 16 includes, for example, a hard disk drive (HDD). The storage 16 may include a semiconductor storage medium such as a solid state drive (SSD) in addition to the HDD or instead of the HDD. The storage 16 records various pieces of information, such as control programs and parameters used by the CPU. In addition, the storage 16 can record image data of a print target. The storage 16 is an example of a storage unit.

The page memory 18 is a memory having a storage area on which the image data for at least one page is loaded.

The control panel 30 can include a display element 32, a touch panel 34, and an input button 36. The display element 32 is a display element such as a liquid crystal display or an organic electroluminescence (EL) display. The display element 32 displays information, such as the state of the image forming apparatus 1 or various settings. In addition, the display element 32 displays options and the like for changing the settings and the like of the image forming apparatus 1. The touch panel 34 is provided on the display element 32. The touch panel 34 together with the display element 32 constitutes a touch screen. The touch panel 34 acquires a user's instruction. The input button 36 includes, for example, a print start button and the like. The input button 36 acquires the user's instruction.

The scanner unit 50 reads images such as characters, figures, and photographs drawn on a recording medium placed at a predetermined position. For this reason, the scanner unit 50 includes a line sensor 51. The line sensor 51 may adopt a charge coupled device (CCD) method, a contact image sensor (CIS) method, or another method. The line sensor 51 is an example of an imaging element. The scanner unit 50 generates the image data based on the image read by the line sensor 51. The scanner unit 50 transmits the generated image data to the control unit 10. The control unit 10 stores the received image data in the storage 16, transmits the image data to the printer unit 100, and transmits the image data to another device via the communication circuit 70.

The communication circuit 70 is a circuit for communicating with an external device of the image forming apparatus 1. The image forming apparatus 1 is connected to a personal computer (PC) or the like via, for example, the communication circuit 70 and a network connected to the communication circuit 70.

The sensor 90 is a sensor that detects environment temperature (temperature of an environment within which the image forming apparatus 1 is located). The storage 16 can store a history (populate a dataset) of the environment temperature detected by the sensor 90 (as a function of time).

The printer unit 100 forms an image on the recording medium. The printer unit 100 forms the image on the surface of the recording medium, for example, based on the image data generated by the scanner unit 50. In addition, the printer unit 100 may form the image on the surface of the recording medium based on the image data transmitted by another information processing apparatus via the network.

Herein, an example of the printer unit 100 using a tandem-type toner image transfer unit will be described. The printer unit 100 includes an accommodation unit 110 (receiver), a carrying unit 120 (carrier), an image formation unit 130 (image former), and a fuser 140. The accommodation unit 110 accommodates a recording medium such as paper, cloth, or a plastic film. The carrying unit 120 carries the recording medium from the accommodation unit 110 to the image formation unit 130 and the fuser 140 in this order. The image formation unit 130 forms the image, such as a character, a figure, or a photograph, on the recording medium. The fuser 140 fixes the formed image on the recording medium. In this manner, the printer unit 100 executes a printing process of printing the image on the recording medium.

Figure 2:
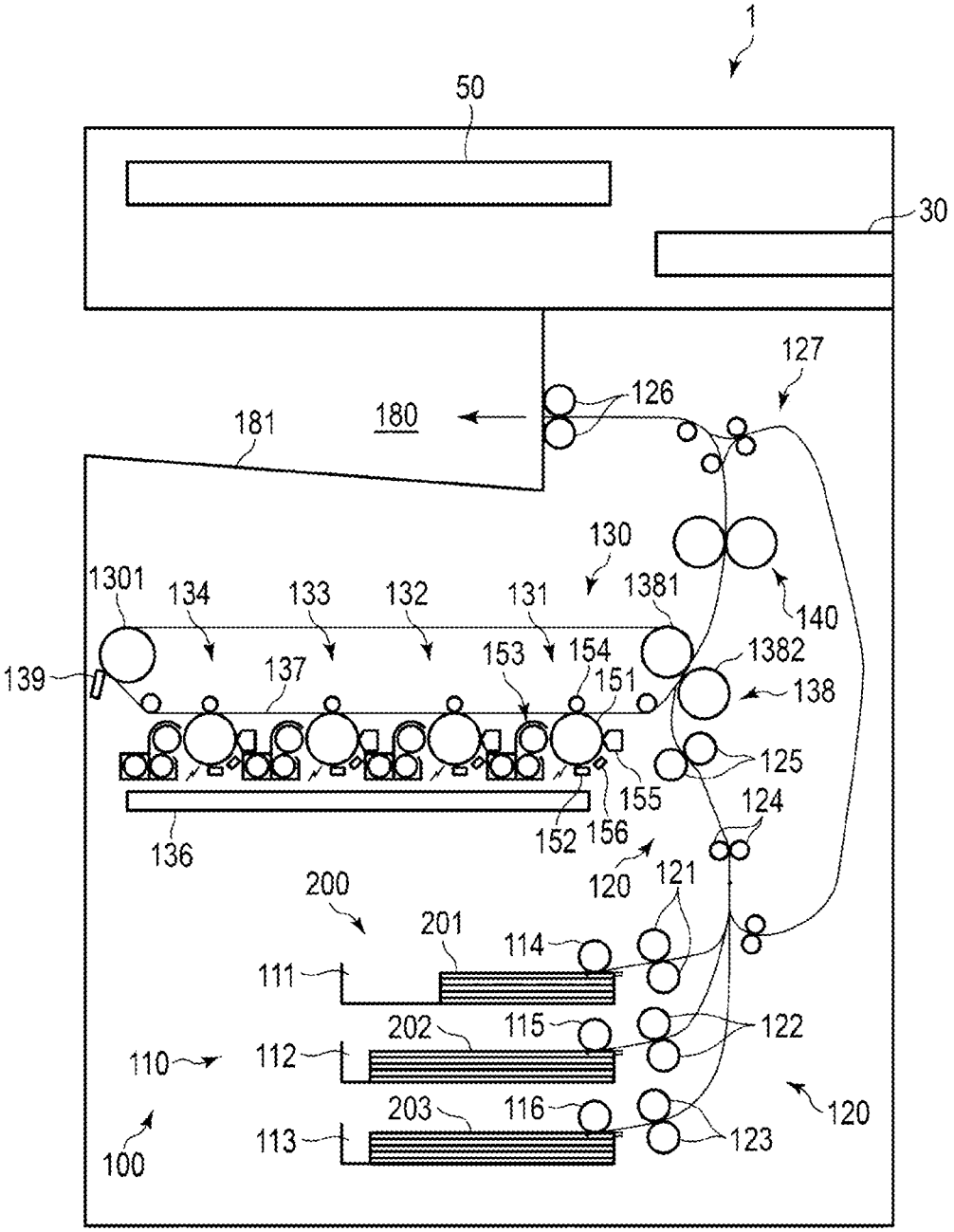
FIG. 2 is a diagram illustrating an outline of an example configuration of a printer unit according to the embodiment.

FIG. 2 is a diagram illustrating an outline of an example configuration of the printer unit 100.

The printer unit 100 will be described with reference to FIG. 2.

The accommodation unit 110 includes a plurality of paper feed cassettes. In the example illustrated in FIG. 2, the accommodation unit 110 includes a first paper feed cassette 111, a second paper feed cassette 112, and a third paper feed cassette 113. The paper feed cassettes accommodate respective recording media 200 of predetermined sizes and types. That is, the first paper feed cassette 111 accommodates a first recording medium 201, the second paper feed cassette 112 accommodates a second recording medium 202, and the third paper feed cassette 113 accommodates a third recording medium 203. Herein, an example of three paper feed cassettes is illustrated, but the number of paper feed cassettes may be one or any number. The recording medium 200 may be simply referred to as a medium.

Each paper feed cassette has a pickup roller. That is, the first paper feed cassette 111 has a first pickup roller 114, the second paper feed cassette 112 has a second pickup roller 115, and the third paper feed cassette 113 has a third pickup roller 116. Each pickup roller picks up the recording medium 200 one by one from each paper feed cassette. Each pickup roller supplies the picked-up recording medium 200 to the carrying unit 120.

The carrying unit 120 carries the recording medium 200 in the printer unit 100. The carrying unit 120 includes carrying rollers 121 to 124, a registration roller 125, and a carrying roller 126. The carrying roller 121 carries the first recording medium 201 supplied by the first pickup roller 114 to the carrying roller 124. The carrying roller 122 conveys the second recording medium 202 supplied by the second pickup roller 115 to the carrying roller 124. The carrying roller 123 transfers the third recording medium 203 supplied by the third pickup roller 116 to the carrying roller 124. The carrying roller 124 further carries the recording medium 200 to the registration roller 125. The registration roller 125 conveys the recording medium 200 to a transfer unit 138 according to the timing at which the transfer unit 138 of the image formation unit 130 described later transfers a toner image to the recording medium 200. The carrying roller 126 is provided on a downstream side of the fuser 140 and discharges the recording medium 200 to a paper ejection unit 180 (ejector). The paper ejection unit 180 may be an opening or tray having a paper reception surface 181. The carrying unit 120 may have an inversion unit 127 that inverts the recording medium 200 when forming the image on both sides of the recording medium 200. The image formation unit 130 forms the toner image on the recording medium 200. The image formation unit 130 includes a plurality of developing units 131 to 134, an exposing device 136, an intermediate transfer belt 137, a transfer unit 138, and a transfer belt cleaner 139. The plurality of developing units 131 to 134 corresponds to the number of types of toner.

The image formation unit 130 includes a black developing unit 131, a cyan developing unit 132, a magenta developing unit 133, and a yellow developing unit 134. The black developing unit 131 is a developing unit corresponding to black (K) toner. The cyan developing unit 132 is a developing unit corresponding to cyan (C) toner. The magenta developing unit 133 is a developing unit corresponding to magenta (M) toner. The yellow developing unit 134 is a developing unit corresponding to yellow (Y) toner. Each developing unit has a similar configuration.

Each developing unit has a photoreceptor drum 151 that functions as an image carrier. Each developing unit includes an electrostatic charger 152, a developing device 153, a primary transfer roller 154, a cleaning unit 155, and an electrostatic eliminator 156 around the photoreceptor drum 151.

The intermediate transfer belt 137 is an endless belt. The intermediate transfer belt 137 is passed between the photoreceptor drum 151 and the primary transfer roller 154 of each developing unit. Furthermore, the intermediate transfer belt 137 is hung around a support roller 1381 (first support roller) of the transfer unit 138 and a support roller 1301 (second support roller). The intermediate transfer belt 137 rotates counterclockwise in FIG. 2.

The photoreceptor drum 151 has a photoreceptor layer on the surface. The photoreceptor drum 151 rotates about an axis clockwise in FIG. 2. The electrostatic charger 152 uniformly charges the photoreceptor layer on the surface of the photoreceptor drum 151. For example, the electrostatic charger 152 may negatively charge the surface of the photoreceptor drum 151.

The exposing device 136 is located at a position facing the photoreceptor drum 151 of each developing unit. The exposing device 136 has a semiconductor laser light source. The exposing device 136 irradiates the surface of the photoreceptor drum 151 of each developing unit with laser light through an optical system such as a polygon mirror. The exposing device 136 executes an operation including light emission based on the image data under the control of the control unit 10. The exposing device 136 forms an electrostatic pattern as an electrostatic latent image at a position irradiated with a laser beam on the surface of the photoreceptor drum 151. It should be noted that the exposing device 136 may use a light emitting diode (LED) instead of the laser light source. The developing device 153 develops the electrostatic latent image on the surface of the photoreceptor drum 151 with the toner. That is, the toner adheres to the electrostatic latent image of the photoreceptor drum 151. Accordingly, the developing device 153 forms the toner image on the surface of the photoreceptor drum 151. The primary transfer roller 154 faces the photoreceptor drum 151 with the intermediate transfer belt 137 interposed therebetween. The primary transfer roller 154 functions as a bias roller. The primary transfer roller 154 transfers the toner image on the surface of the photoreceptor drum 151 to the intermediate transfer belt 137. This transfer is called primary transfer. The black developing unit 131, the cyan developing unit 132, the magenta developing unit 133, and the yellow developing unit 134 can multiple-transfer the toner images of the respective colors on the intermediate transfer belt 137.

The cleaning unit 155 is located after the position at which the toner image on the surface of the photoreceptor drum 151 is transferred to the intermediate transfer belt 137. The cleaning unit 155 scrapes and removes non-transferred toner and the like on the surface of the photoreceptor drum 151. The cleaning unit 155 collects the removed toner in a waste toner tank.

The electrostatic eliminator 156 faces the photoreceptor drum 151 that passes through the cleaning unit 155. The electrostatic eliminator 156 irradiates the surface of the photoreceptor drum 151 with light. The electrostatic eliminator 156 eliminates electrostatic electricity from the photoreceptor layer by irradiation with light. The charge of the photoreceptor layer becomes uniform.

The transfer unit 138 includes the support roller 1381 and a secondary transfer roller 1382. The support roller 1381 and the secondary transfer roller 1382 are configured to interpose the intermediate transfer belt 137 and the recording medium 200 from both sides in the thickness direction. The support roller 1381 is a drive roller for the intermediate transfer belt 137. The secondary transfer roller 1382 faces the support roller 1381 with the intermediate transfer belt 137 interposed therebetween. The transfer unit 138 transfers the charged toner image on the surface of the intermediate transfer belt 137 to the surface of the recording medium 200. This transfer is called secondary transfer.

The transfer belt cleaner 139 is located between the transfer unit 138 and the developing unit in the moving direction of the intermediate transfer belt 137. The transfer belt cleaner 139 removes non-transferred toner on the surface of the intermediate transfer belt 137 after the toner image is transferred from the intermediate transfer belt 137 to the recording medium 200.

The fuser 140 applies heat and pressure to the recording medium 200 on which the toner image supplied from the image formation unit 130 is formed. The fuser 140 fixes the toner image formed on the recording medium 200 by the heat and pressure. An example configuration of the fuser 140 will be described in the following. The image forming apparatus 1 may be an apparatus that can perform printing using a decolorable toner. The decolorable toner is a toner that decolorizes by an external stimulus such as temperature, light of a specific wavelength, or pressure.

[Configuration of Fuser]

Figure 3:
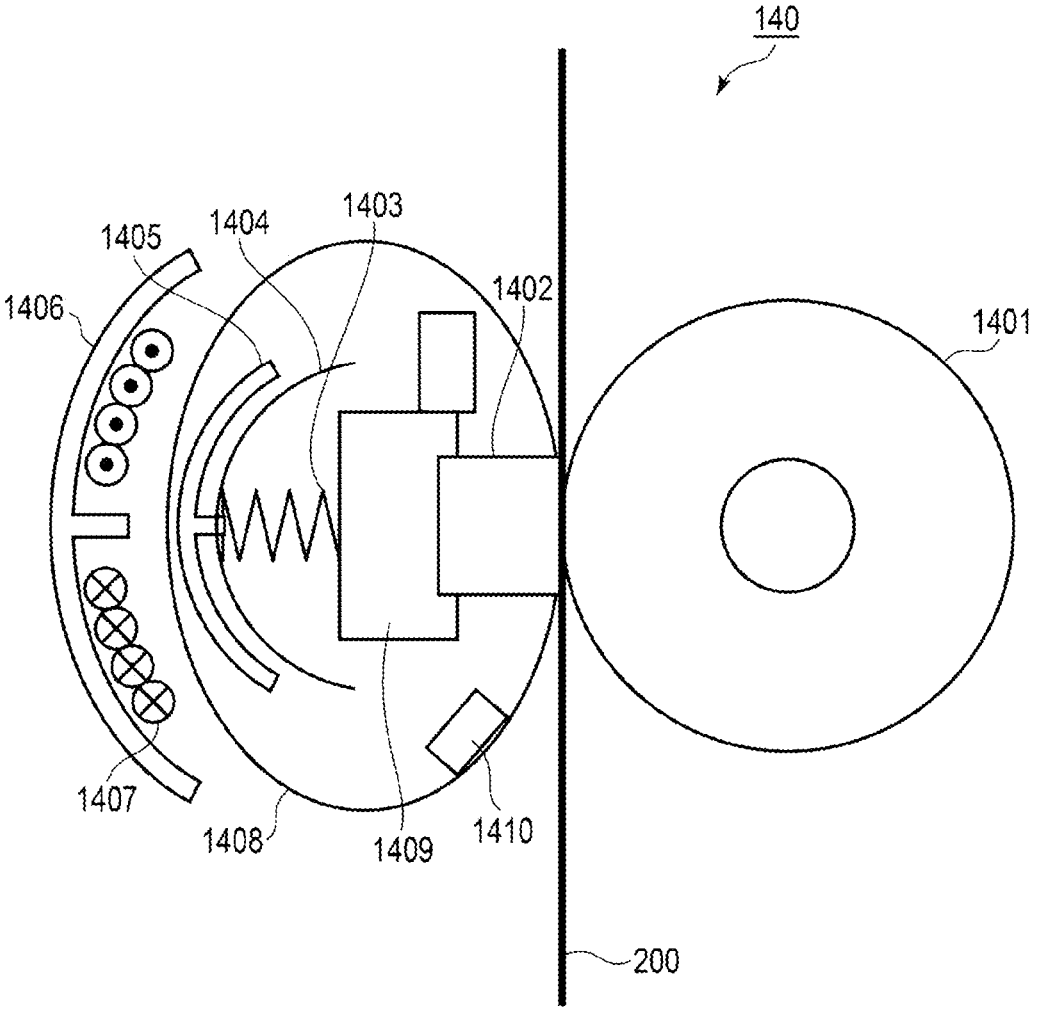
FIG. 3 is a diagram illustrating an outline of an example configuration of a fuser according to the embodiment.

FIG. 3 is a diagram illustrating an outline of an example configuration of the fuser 140.

For example, the fuser 140 is an induction heating type fuser. The fuser 140 includes a pressurizing roller 1401 (roller), a pressurizing pad 1402 (pad), a magnetic alignment alloy position adjusting mechanism 1403 (adjustor), an aluminum member 1404 (shield), a magnetic alignment alloy 1405 (aligner), a ferrite core 1406, a coil 1407, and a fixing belt 1408, a frame 1409, and a sensor 1410.

The pressurizing roller 1401 is located so as to face the fixing belt 1408 on a circumferential surface of the fixing belt 1408. The pressurizing roller 1401 is in contact with the fixing belt 1408 by springs at both ends. The pressurizing roller 1401 has a metal member as a core material and has an elastic layer such as a rubber layer on the outside thereof. The pressurizing roller 1401 has a release layer on the surface. The pressurizing roller 1401 is rotationally driven. The pressurizing roller 1401 may allow the fixing belt 1408 to be driven. The pressurizing roller 1401 may have a one-way clutch so as not to cause a speed difference from the fixing belt 1408.

The pressurizing pad 1402 is located inside the fixing belt 1408. The pressurizing pad 1402 presses the fixing belt 1408 toward the pressurizing roller 1401. A nip portion is formed between the fixing belt 1408 and the pressurizing roller 1401. The shape of the portion of the pressurizing pad 1402 facing the pressurizing roller 1401 is the same as the outer circumferential shape of the pressurizing roller 1401. A width of the pressurizing pad 1402 in a longitudinal direction is wider than a width of the recording medium 200 to be conveyed. The pressurizing pad 1402 has a low friction sheet between the pressurizing pad 1402 and the pressurizing roller 1401 in order to improve slidability. The pressurizing pad 1402 is configured with a heat-resistant resin. The heat-resistant resin is, for example, polyetheretherketone (PEEK), phenol resin, or the like. The magnetic alignment alloy position adjusting mechanism 1403 is fixed to the frame 1409. The magnetic alignment alloy position adjusting mechanism 1403 is a position adjusting mechanism of the magnetic alignment alloy 1405. The magnetic alignment alloy position adjusting mechanism 1403 has a spring. The magnetic alignment alloy position adjusting mechanism 1403 adjusts the position of the magnetic alignment alloy 1405 by the force of the spring.

The aluminum member 1404 is connected to the magnetic alignment alloy position adjusting mechanism 1403. The aluminum member 1404 shields the magnetic flux generated by the coil 1407.

The magnetic alignment alloy 1405 faces the coil 1407 with the fixing belt 1408 interposed therebetween. When the temperature of the magnetic alignment alloy 1405 is equal to or higher than a Curie point temperature, magnetic permeability is decreased, and a magnetic flux density transmitting through the fixing belt 1408 is reduced. For this reason, a heat generation amount of the magnetic alignment alloy 1405 is reduced.

The ferrite core 1406 is located outside the coil 1407. The ferrite core 1406 shields the magnetic flux generated by the coil 1407.

The coil 1407 is located outside the fixing belt 1408. The coil 1407 generates a magnetic flux.

The fixing belt 1408 is an endless belt. The fixing belt 1408 rotates counterclockwise in FIG. 3. The fixing belt 1408 has a plurality of layers. The fixing belt 1408 has a conductive layer that generates induction heat by a magnetic field generated by the coil 1407. For example, the conductive layer is configured with a conductive material such as iron, nickel (Ni), or copper (Cu). The fixing belt 1408 may have a Cu layer stacked on a Ni layer. The fixing belt 1408 has an elastic layer on the conductive layer. The fixing belt 1408 has a release layer on the conductive layer. The release layer is a layer that is in direct contact with the toner. The release layer is preferably made of a tetrafluoroethylene, perfluoroalkyl vinyl ether copolymer resin (PFA) or the like having good releasability.

The frame 1409 is located inside the fixing belt 1408. The frame 1409 retains the pressurizing pad 1402.

The sensor 1410 is located inside the fixing belt 1408. The sensor 1410 is located on a downstream side of a heating portion configured with the magnetic alignment alloy 1405 and the coil 1407 and on an upstream side of the nip portion formed between the fixing belt 1408 and the pressurizing roller 1401. The sensor 1410 is located at a central portion of the fixing belt 1408 in the longitudinal direction. The longitudinal direction of the fixing belt 1408 is a direction perpendicular to a rotation direction of the fixing belt 1408. The longitudinal direction of the fixing belt 1408 is also a direction perpendicular to a conveying direction of the recording medium 200. The central portion of the fixing belt 1408 in the longitudinal direction faces the recording medium 200 passing between the fixing belt 1408 and the pressurizing roller 1401. The sensor 1410 may be a contact type thermistor.

The sensor 1410 detects temperature of an inner surface of the fixing belt 1408. The sensor 1410 detects temperature of the central portion of the fixing belt 1408 in the longitudinal direction, on the inner surface of the fixing belt 1408. Detecting the temperature of the inner surface of the fixing belt 1408 is an example of detecting the temperature of the fixing belt 1408. Detecting the temperature of the fixing belt 1408 is an example of detecting the temperature of the fuser 140. The storage 16 can store a history (populate a dataset) of the temperatures detected by the sensor 1410 (as a function of time).

[Configuration of Fixing Belt]

Figure 4:
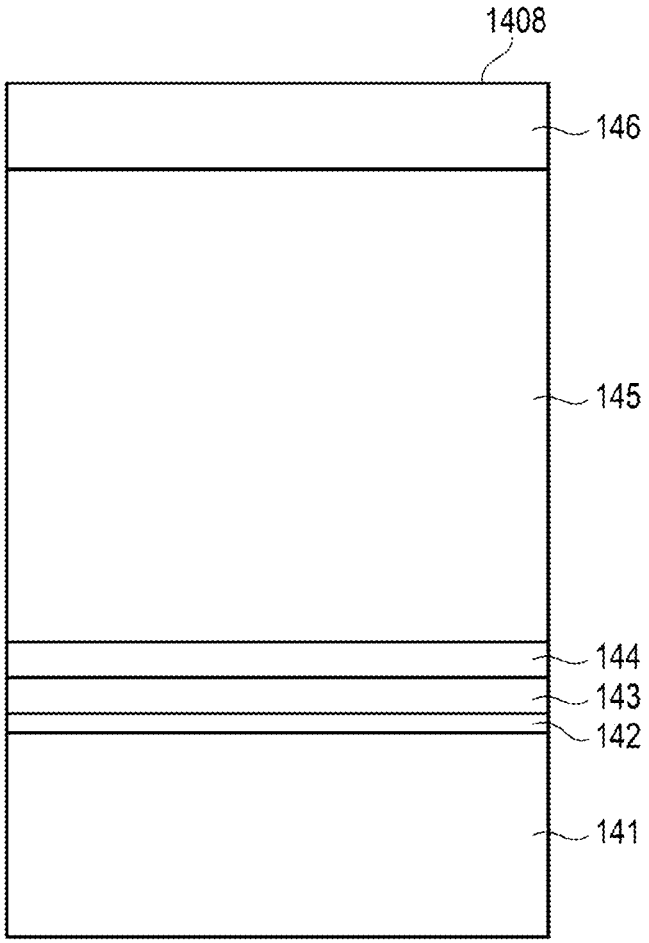
FIG. 4 is a diagram illustrating an outline of an example configuration of a fixing belt according to the embodiment.

FIG. 4 is a diagram illustrating an outline of an example configuration of the fixing belt 1408.

The fixing belt 1408 uses a polyimide sleeve 141 as a base material. The fixing belt 1408 includes a Ni layer 142, a Cu layer 143, a Ni layer 144, a silicon (Si) rubber layer 145, and a PFA tube 146 on the polyimide sleeve 141 in this order from the bottom. The polyimide sleeve 141 may be 70 micrometers (μm). The Ni layer 142 may be 1 μm. The Cu layer 143 may be 10 μm. The Ni layer 144 may be 8 μm. The Si rubber layer 145 may be 200 μm. The PFA tube 146 may be 30 μm.

[Outline of Power Control]

Figure 5:
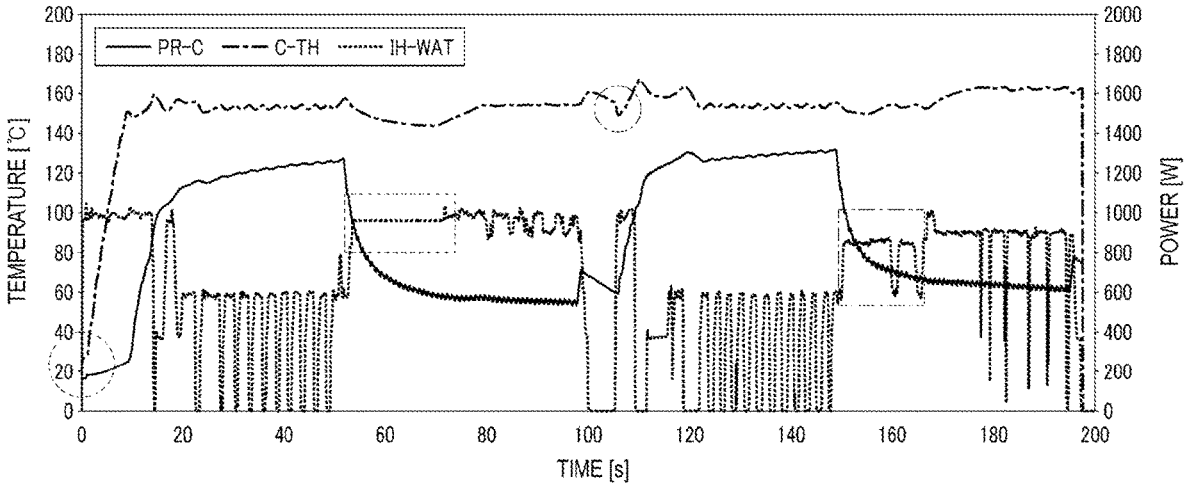
FIG. 5 is a diagram illustrating an outline of an example of power control for a fuser according to the embodiment.

FIG. 5 is a diagram illustrating an outline of an example of power control of the fuser 140.

FIG. 5 illustrates graphs of C-TH, PR-C, and IH-WAT. The graph of C-TH is a graph of transition of the temperature detected by the sensor 1410 with the elapse of time (as a function of time). The graph of PR-C is a graph of transition of a surface temperature of the pressurizing roller 1401 with the elapse of time. Since the image forming apparatus 1 does not include a sensor for detecting the surface temperature of the pressurizing roller 1401, FIG. 5 illustrates a graph of PR-C as a reference example. The graph of IH-WAT is a graph of the transition of power supplied to the fuser 140 with the elapse of time. The horizontal axis represents time. The vertical axis of the C-TH and PR-C graphs represents temperature. The vertical axis of the IH-WAT graph represents power. A sensor dedicated to sensing a temperature of the pressurizing roller 1401 is not required in the image forming apparatus 1, as the temperature of the pressurizing roller 1401 may still be determined in other ways in some embodiments (e.g., using other sensors within the image forming apparatus 1, etc.).

0 seconds is the timing before the fuser 140 warms up (before the fuser 140 reaches the warm up temperature of the fuser 140). The warming up is a control that starts supplying power to the coil 1407 in a state where the power supply is stopped by the control circuit 12 and stabilizes the temperature of the fixing belt 1408 detected by the sensor 1410 at a target temperature. The warming up is obtained before starting a job-based printing process by the printer unit 100. The state before the warming up is a state where the power supply to the coil 1407 is stopped by the control of the control circuit 12.

The period from 0 to about (e.g., within 5% of) 50 seconds is defined as a period A. The period A is the warming up period of the fuser 140 (the period of time before the fuser 140 reaches the warm up temperature of the fuser 140).

The period from about 50 seconds to about 100 seconds is defined as a period B. The period B is a paper passing period in which the recording medium 200 is supplied to the fuser 140 by an image printing process based on a first job by the printer unit 100. For example, the start timing of the period B is the timing of starting the supply of the recording medium 200 to the fuser 140. The end timing of the period B is the timing of ending the supply of the recording medium 200 to the fuser 140.

The period from about 100 seconds to about 105 seconds is defined as a period C. The period C is a period in a state where the power supply to the fuser 140 is stopped by the control of the control circuit 12 after the supply of the recording medium 200 to the fuser 140 by the printer unit 100 is ended.

The period from around 105 seconds to around 150 seconds is defined as a period D. The period D is a warming up period of the fuser 140.

The period from around 150 seconds to around 197 seconds is defined as a period E. The period E is a paper passing period in which the recording medium 200 is supplied to the fuser 140 by the image printing process based on a second job by the printer unit 100. The second job is a job to be processed after the first job. For example, the start timing of the period E is the timing of starting the supply of the recording medium 200 to the fuser 140. The end timing of the period E is the timing of ending supply of the recording medium 200 to the fuser 140.

The period from around 197 seconds to around 200 seconds is defined as a period F. The period F is a period in a state where the power supply to the fuser 140 is stopped by the control of the control circuit 12 after the supply of the recording medium 200 to the fuser 140 by the printer unit 100 is ended.

The control of the power supplied to the fuser 140 by the control circuit 12 during the paper passing periods of the period B and the period E will be described.

The control circuit 12 changes the control of the power supplied to the fuser 140 after the start of the supplying the recording medium 200 to the fuser 140 according to the temperature detected by the sensor 1410 before the warming up. In the following, the temperature detected by the sensor 1410 before the warming up of the fuser 140 is referred to as a temperature before the warming up. The control circuit 12 can acquire the temperature before the warming up from the storage 16. The temperature before the warming up is the temperature in a state where the power supply to the fuser 140 is stopped by the control of the control circuit 12. For example, the temperature before the warming up is the temperature detected by the sensor 1410 immediately before the start of the warming up. Immediately before the start of the warming up is immediately before the timing of starting the power supply to the fuser 140.

An example in which the control circuit 12 sets the control of the power supplied to the fuser 140 to any one of two stages by using a first threshold value is described, but the control circuit 12 is not limited thereto. The control circuit 12 may set the control of the power supplied to the fuser 140 to any one of three or more stages by using a plurality of different first threshold values. The first threshold value is described to be 60 degrees Celsius (° C.), but the first threshold value is not limited thereto.

The control circuit 12 controls the power supplied to the fuser 140 during the period surrounded by a broken line quadrangle based on the temperature before the warming up surrounded by a broken line circle. The broken line circle indicates the temperature detected by the sensor 1410 at time of 0 seconds. The temperature at time of seconds is lower than the first threshold value. The period surrounded by the broken line quadrangle is a portion of the period B. The period surrounded by the broken line quadrangle is the period after the start of the supplying of the recording medium 200 to the fuser 140. The start timing of the period surrounded by the broken line quadrangle is the timing of starting the supply of the recording medium 200 to the fuser 140, which is the same as the start timing of the period B. The length of the period surrounded by the broken line quadrangle can be set or changed.

The control circuit 12 controls the power supplied to the fuser 140 during the period surrounded by the one-dot dashed line quadrangle based on the temperature before the warming up surrounded by the one-dot dashed line circle. The one-dot dashed line circle indicates the temperature detected by the sensor 1410 near the time of 105 seconds. The temperature near the time of 105 seconds is equal to or higher than the first threshold value. The period surrounded by the one-dot dashed line quadrangle is a portion of the period E. The period surrounded by the one-dot dashed line quadrangle is the period after the start of the supplying of the recording medium 200 to the fuser 140. The start timing of the period surrounded by the one-dot dashed line quadrangle is the timing of starting the supply of the recording medium 200 to the fuser 140, which is the same as the start timing of the period E. The length of the period surrounded by the one-dot dashed line quadrangle can be set or changed. As illustrated below, the control of the power supplied to the fuser 140 by the control circuit 12 differs between the period surrounded by the broken line quadrangle and the period surrounded by the one-dot dashed line quadrangle.

One of the reasons why the control circuit 12 changes the control of the power supplied to the fuser 140 after the start of the supplying of the recording medium 200 to the fuser 140 according to the temperature before the warming up will be described. The heat of the fixing belt 1408 is transferred to the pressurizing roller 1401 that is in contact with the fixing belt 1408 during the paper passing period. The ease of the heat transfer varies according to the heat storage state of the pressurizing roller 1401 that is in contact with the fixing belt 1408. When the pressurizing roller 1401 is in a heat storage state where the pressurizing roller 1401 is not warmed up to the inside, it is easy to transfer heat from the fixing belt 1408 to the pressurizing roller 1401. When the pressurizing roller 1401 is in a heat storage state where not only the surface but also the inside of the pressurizing roller 1401 is warmed, it is difficult to transfer heat from the fixing belt 1408 to the pressurizing roller 1401. For this reason, the control circuit 12 changes the control of the power supplied to the fuser 140 after start of the supplying of the recording medium 200 to the fuser 140. In addition, since the image forming apparatus 1 does not include a sensor for detecting the surface temperature of the pressurizing roller 1401, the control circuit 12 cannot detect the heat storage state of the pressurizing roller 1401. Since the fixing belt 1408 is in contact with the surface of the pressurizing roller 1401, the temperature detected by the sensor 1410 before the warming up reflects the heat storage state of the pressurizing roller 1401. Since the temperature detected by the sensor 1410 after the warming up or at the start of the paper passing period increases to the target temperature, the temperature detected by the sensor 1410 does not reflect the heat storage state of the pressurizing roller 1401. For this reason, the control circuit 12 uses the temperature before the warming up.

For example, the control circuit 12 changes the upper limit value and the lower limit value of the power supplied to the fuser 140 after the start of the supplying of the recording medium 200 to the fuser 140 according to the temperature before the warming up. The control circuit 12 changes the upper limit value and the lower limit value according to whether or not the temperature before the warming up to be equal to or higher than the first threshold value. The control circuit 12 sets the upper limit value and the lower limit value when the temperature before the warming up is lower than the first threshold value to be higher than the upper limit value and the lower limit value when the temperature is equal to or higher than the first threshold value. For example, the control circuit 12 sets the upper limit value to 960 Watts (W) and sets the lower limit value to 800 W based on the fact that the temperature before the warming up is lower than the first threshold value. The control circuit 12 sets the upper limit value to 830 W and sets the lower limit value to 600 W based on the fact that the temperature before the warming up is equal to or higher than the first threshold value. For example, the control circuit 12 uses either the upper limit value or the lower limit value according to whether or not the temperature detected by the sensor 1410 to be 150° C. or higher.

The control circuit 12 can change (vary) the upper limit value and the lower limit value according to the temperature before the warming up. Accordingly, the control circuit 12 can reduce the excess or deficiency of the power supply to the fuser 140 or the excess or deficiency of the heat storage of the fuser 140. In a state where it is easy to transfer heat from the fixing belt 1408 to the pressurizing roller 1401, the control circuit 12 can prevent the temperature from decreasing by setting the upper limit value and the lower limit value to be high. In a state where it is difficult to transfer heat from the fixing belt 1408 to the pressurizing roller 1401, the control circuit 12 can prevent the temperature from increasing too much by setting the upper limit value and the lower limit value to be low.

For example, the control circuit 12 changes the length of the period of maintaining the power supplied to the fuser 140 at the upper limit value after the start of the supplying of the recording medium 200 to the fuser 140 according to the temperature before the warming up. The control circuit 12 changes the length of the period of maintaining the power at the upper limit value according to whether or not the temperature before the warming up to be equal to or higher than the first threshold value. The control circuit 12 sets the length of the period of maintaining the power at the upper limit value when the temperature before the warming up is lower than the first threshold value to be larger than the length of the period of maintaining the power at the upper limit value when the temperature is equal to or higher than the first threshold value. The length of the period of maintaining the power at the upper limit value may be changed according to the setting, as described in the following. As described later, the length of the period of maintaining the power at the upper limit value may also be changed according to the transition in which the temperature detected by the sensor 1410 becomes equal to or higher than the second threshold value after the temperature stops decreasing (after a change in the temperature is less than a threshold). The period of maintaining the power at the upper limit value can end at the earlier timing of the end timing of the period set according to the combination of the former and the latter and the end timing based on the temperature transition.

For example, the control circuit 12 sets a first period of maintaining the power at the upper limit value based on the fact that the temperature before the warming up is lower than the first threshold value. The control circuit 12 maintains the power supplied to the fuser 140 at the upper limit value for the first period after the start of the supplying of the recording medium to the fuser 140. The control circuit 12 sets a second period of maintaining the power at the upper limit value based on the fact that the temperature before the warming up is equal to or higher than the first threshold value. The control circuit 12 maintains the power supplied to the fuser 140 at an upper limit value for the second period after the start of the supplying of the recording medium 200 to the fuser 140. The length of the second period is smaller than the length of the first period. The start timing of the period of maintaining the power at the upper limit value may be equal to the start timing of the supply of the recording medium 200 to the fuser 140. The start timing of the period of maintaining the power at the upper limit value may be later than the start timing of the supply of the recording medium 200.

The control circuit 12 can change the length of the period of maintaining the power at the upper limit value according to the temperature before the warming up. Accordingly, the control circuit 12 can reduce the excess or deficiency of the power supply to the fuser 140 or the excess or deficiency of the heat storage of the fuser 140. In a state where it is easy to transfer heat from the fixing belt 1408 to the pressurizing roller 1401, the control circuit 12 can prevent the temperature from decreasing by setting the length of the period of maintaining the power at the upper limit value to be large. In a state where it is difficult to transfer heat from the fixing belt 1408 to the pressurizing roller 1401, the control circuit 12 can prevent the temperature from increasing too much by setting the length of the period of maintaining the power at the upper limit value to be small.

The control circuit 12 may maintain the power supplied to the fuser 140 at the upper limit value after the start of the supplying of the recording medium 200 to the fuser 140 and may end maintaining the power at the upper limit value at the following timing. The control circuit 12 ends maintaining the power supplied to the fuser 140 at the upper limit value based on the fact that the temperature detected by the sensor 1410 is equal to or higher than the second threshold value after the temperature stops decreasing. The second threshold value is described to be 145° C., but the second threshold value is not limited thereto. In this example, the control circuit 12 acquires the temperature detected by the sensor 1410 in time series. The control circuit 12 continues to compare the acquired temperature with the second threshold value. Based on continuous comparison, the control circuit 12 detects that the temperature detected by the sensor 1410 is equal to or higher than the second threshold value after the temperature stops decreasing. The temperature being equal to or higher than the second threshold value after the temperature stops decreasing includes the fact that the temperature stops decreasing and the temperature is equal to or higher than the second threshold value. The temperature stopping decreasing includes the fact that the decrease of the temperature does not occur for a certain time or more. For example, the certain time is 2 seconds or the like, but the length of the certain time can be set as appropriate. The temperature being equal to or higher than the second threshold value after the temperature stops decreasing includes the fact that the temperature stops decreasing to be equal to or higher than the second threshold value. The temperature being equal to or higher than the second threshold value after the temperature stops decreasing includes the fact that the temperature stops decreasing to be lower than the second threshold value and the temperature is transitioned from a value of being lower than the second threshold value to a value of being equal to or higher than the second threshold value. The control circuit 12 may end maintaining the power at the upper limit value at the timing when the temperature detected by the sensor 1410 is equal to or higher than the second threshold value after the temperature stops decreasing. The control circuit 12 may end maintaining the power at the upper limit value after the temperature detected by the sensor 1410 continues to be the second threshold value or higher for a certain period after the temperature stops decreasing.

When setting the period of maintaining the power at the upper limit value, the control circuit 12 can end maintaining the power at the upper limit value based on the transition of the temperature detected by the sensor 1410 as described above. The control circuit 12 ends maintaining the power at the upper limit value at the earlier timing of the end timing of the period of maintaining the power at the upper limit value and the end timing based on the transition of the temperature detected by the sensor 1410.

It should be noted that even when the period of maintaining the power at the upper limit value is not set, the control circuit 12 can end maintaining the power at the upper limit value based on the transition of the temperature detected by the sensor 1410. The start timing of the period of maintaining the power at the upper limit value may be equal to the start timing of the supply of the recording medium 200 to the fuser 140. The start timing of the period of maintaining the power at the upper limit value may be later than the start timing of the supply of the recording medium 200.

The control circuit 12 can end maintaining the power at the upper limit value based on the transition of the temperature detected by the sensor 1410. Accordingly, the control circuit 12 can prevent the temperature detected by the sensor 1410 from continuing to rapidly increase.

The control circuit 12 may change the control of the power supplied to the fuser 140 after the start of the supplying of the recording medium 200 to the fuser 140, according to the type of the recording medium 200. For example, the type of recording medium 200 is thickness. The control circuit 12 may acquire the type of the recording medium 200 based on the job related to the printing process by the printer unit 100.

The control circuit 12 may change the upper limit value and the lower limit value according to the type of the recording medium 200 supplied to the fuser 140. The control circuit 12 may set the upper limit value and the lower limit value to be higher than the reference upper limit value and the reference lower limit value based on the fact that the thickness of the recording medium 200 supplied to the fuser 140 is larger than the reference thickness. For example, the reference thickness is the thickness of plain paper, but reference thickness is not limited thereto. When the temperature before the warming up is lower than the first threshold value, the reference upper limit value and the reference lower limit value may be the upper limit value of 960 W and the lower limit value of 800 W as described above. When the temperature before the warming up is equal to or higher than the first threshold value, the reference upper limit value and the reference lower limit value may be the upper limit value of 830 W and the lower limit value of 600 W as described above. The control circuit 12 may set the upper limit value and the lower limit value to be lower than the reference upper limit value and the reference lower limit value based on the fact that the thickness of the recording medium 200 supplied to the fuser 140 is smaller than the reference thickness.

The control circuit 12 may change the length of the period of maintaining the power at the upper limit value according to the type of the recording medium 200. The control circuit 12 may set the period of maintaining the power at the upper limit value to be longer than the reference length based on the fact that the thickness of the recording medium 200 supplied to the fuser 140 is larger than the reference thickness. The control circuit 12 may set the period of maintaining the power at the upper limit value to be shorter than the reference length based on the fact that the thickness of the recording medium 200 supplied to the fuser 140 is smaller than the reference thickness.

The control circuit 12 can change at least one of the upper limit value, the lower limit value, or the length of the period of maintaining the power at the upper limit value according to the type of the recording medium 200. As the recording medium 200 becomes thicker, it tends to become easy to decrease the temperature of the recording medium 200 that is detected by the sensor 1410. The control circuit 12 can prevent the temperature from decreasing or increasing too much by changing the upper limit value and the lower limit value according to the type of the recording medium 200. The same is applied for changing the length of the period of maintaining. The control circuit 12 may change the control of the power supplied to the fuser 140 after the start of the supplying of the recording medium 200 to the fuser 140 according to the environment temperature. The control circuit 12 acquires the environment temperature detected by the sensor 90. The control circuit 12 may acquire the environment temperature immediately before the start of the supplying of the recording medium 200 to the fuser 140.

The control circuit 12 may change the upper limit value and the lower limit value according to the environment temperature. The control circuit 12 may set the upper limit value and the lower limit value to be higher than the reference upper limit value and the reference lower limit value based on the fact that the environment temperature is lower than the third threshold value. The third threshold value can be set or changed. The control circuit 12 may set the upper limit value and the lower limit value to be lower than the reference upper limit value and the reference lower limit value based on the fact that the environment temperature is equal to or higher than the third threshold value.

The control circuit 12 may change the length of the period of maintaining the power at the upper limit value according to the environment temperature. The control circuit 12 may set the period of maintaining the power at the upper limit value to be longer than the reference length based on the fact that the environment temperature is lower than the third threshold value. The control circuit 12 may set the period of maintaining the power at the upper limit value to be shorter than the reference length based on the fact that the environment temperature is equal to or higher than the third threshold value.

Figure 6:
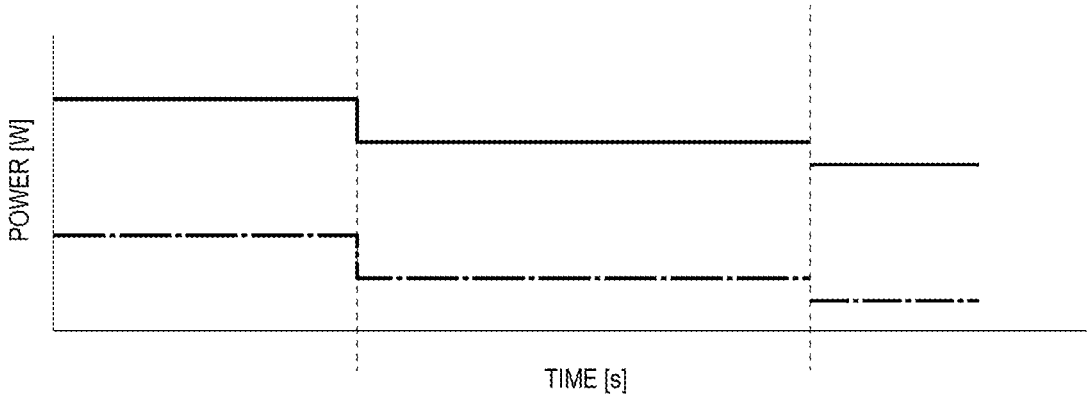
FIG. 6 is a diagram illustrating an outline of another example of power control of the fuser according to the embodiment.

The control circuit 12 can change at least one of the upper limit value, the lower limit value, or the length of the period of maintaining the power at the upper limit value according to the environment temperature. Since the temperature of the recording medium 200 decreases as the environment temperature decreases, the recording medium 200 tends to be easy to decrease the temperature detected by the sensor 1410 when the environment temperature is low. The control circuit 12 can prevent the temperature from decreasing or increasing too much by changing the upper limit value and the lower limit value according to the environment temperature. The same is applied for changing the length of the period of maintaining. FIG. 6 is a diagram illustrating an outline of another example of power control of the fuser 140.

FIG. 6 is a modified example of an embodiment of setting the upper limit value and the lower limit value of the power supplied to the fuser 140 by the control circuit 12 described above.

The graph illustrated in FIG. 6 is a graph of transition of power supplied to the fuser 140 with the elapse of time. The horizontal axis represents time. The vertical axis represents power. The upper limit value is indicated by a solid line. The lower limit value is indicated by a one-dot dashed line.

The control circuit 12 may be set so as to reduce the upper limit value and the lower limit value stepwise. 0 seconds is set as the start timing of the periods of the upper limit value and the lower limit value set by the control circuit 12 according to the temperature before the warming up as described above. The control circuit 12 reduces the upper limit value and the lower limit value based on the fact that the temperature detected by the sensor 1410 is equal to or higher than the second threshold value after the temperature stops decreasing. In the example illustrated in FIG. 6, the control circuit 12 reduces the upper limit value and the lower limit value twice based on the fact that the temperature detected by the sensor 1410 is equal to or higher than the second threshold value after the temperature stops decreasing. The number of times of reducing the upper limit value and the lower limit value is not limited thereto. The control circuit 12 may change the timing of reducing the upper limit value and the lower limit value with time. By reducing the upper limit value and the lower limit value stepwise, the control circuit 12 prevents the temperature from decreasing or increasing too much, and thus, it is easy to stabilize the temperature.

[Power Control Operation]

Figure 7:
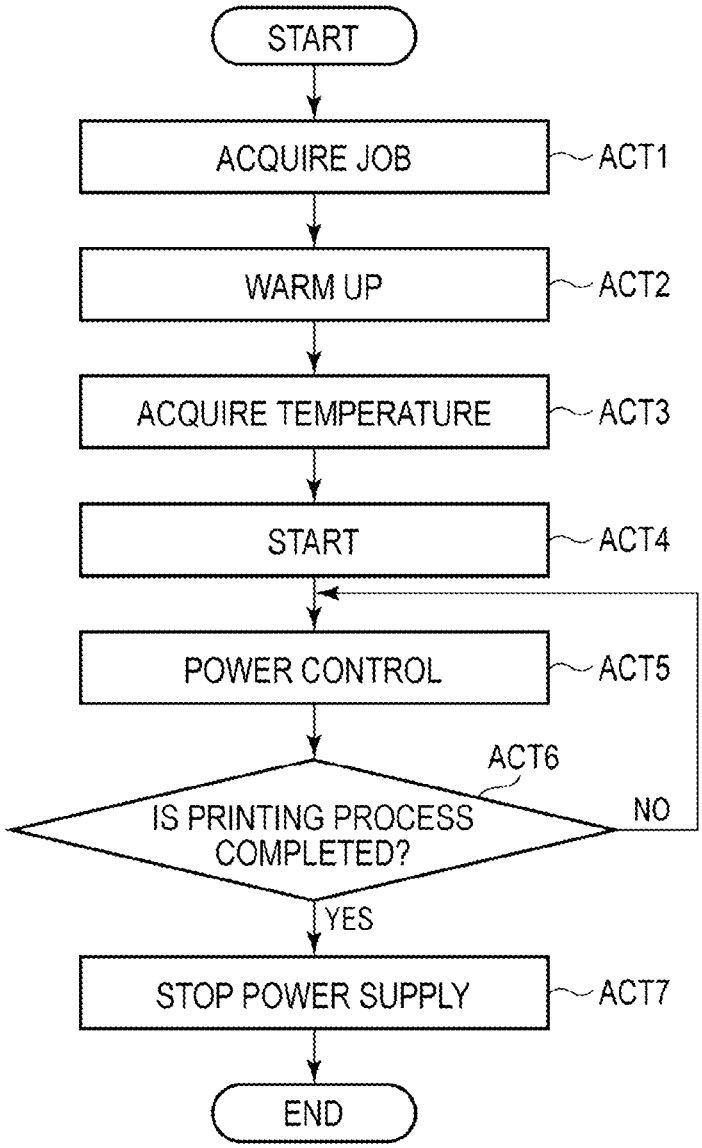
FIG. 7 is a flowchart illustrating a processing procedure of a power control operation in the image forming apparatus according to the embodiment.

FIG. 7 is a flowchart illustrating a processing procedure of the power control operation in the image forming apparatus 1.

The processing procedure described below is only an example, and each processing may be changed as much as possible. With respect to the processing procedure, according to the embodiment, each processing can be omitted or replaced, and new processing can be added.

The control circuit 12 acquires a job (ACT1). In ACT1, for example, the control circuit 12 acquires a job related to the printing process by the printer unit 100 from a personal computer via the communication circuit 70.

The control circuit 12 starts warming up of the fuser 140 (ACT2). In ACT2, for example, the control circuit 12 starts supplying power to the fuser 140 in a state where the power supply is stopped, based on the acquisition of the job. The control circuit 12 supplies the power to the fuser 140 while monitoring the transition of the temperature detected by the sensor 1410. The control circuit 12 raises the temperature by supplying the power to the fuser 140 and, after that, thins out the power, and supplies the power to stabilize the temperature detected by the sensor 1410 at the target temperature. The control circuit 12 acquires the temperature before the warming up (ACT3). In ACT3, for example, the control circuit 12 acquires the temperature before the warming up from the storage 16.

The control circuit 12 starts a job-based printing process (ACT4). In ACT4, for example, the printer unit 100 starts a job-based image printing process under the control of the control circuit 12. The control circuit 12 controls supply of power to the fuser 140 during the paper passing period of the fuser 140 (ACT5). In ACT5, for example, as described above, the control circuit 12 changes the control of the power supplied to the fuser 140 after the start of the supplying of the recording medium 200 to the fuser 140 according to the temperature before the warming up.

The control circuit 12 determines whether or not to complete the job-based printing process (ACT6). In the ACT 6, for example, the control circuit 12 determines whether or not the printer unit 100 completes a printing process of the last image based on the job. When the printer unit 100 does not complete the printing process (NO in ACT6), the control circuit 12 continues to control the power supply to the fuser 140 during the paper passing period of the fuser 140. When the printer unit 100 completes the printing process (YES in ACT6), the control circuit 12 stops the power supply to the fuser 140 (ACTT).

According to the embodiment, the control circuit 12 changes the control of the power supplied to the fuser 140 after the start of the supplying of the recording medium 200 to the fuser 140 according to the temperature before the warming up. Accordingly, the image forming apparatus 1 can reduce the excess or deficiency of the power supply to the fuser 140 or the excess or deficiency of the heat storage of the fuser 140 and can reduce the occurrence of image defects immediately after the start of the printing.

In the embodiment, the fuser is described to be configured like the fuser 140 described above, but the fuser is not limited thereto. A nip forming member of the fuser may be configured with a heat roller and a pressurizing belt, a fixing belt and a pressurizing belt, or configured with a heat roller and a pressurizing roller. A heat generating body of the fuser may be a ceramic heater, a halogen heater, or a halogen lamp.

While certain embodiments have been described, these embodiments have been presented by way of example only, and are not intended to limit the scope of the present disclosure. Indeed, the novel apparatus and methods described herein may be embodied in a variety of other forms; furthermore, various omissions, substitutions and changes in the form of the apparatus and methods described herein may be made without departing from the spirit of the present disclosure. The accompanying claims and their equivalents are intended to cover such forms or modifications as would fall within the scope and spirit of the present disclosure.

What is claimed is:

1. An image forming apparatus comprising:

an image former configured to form an image on a recording medium;

a fuser configured to fix the image on the recording medium;

a first sensor configured to detect a temperature of the fuser; and a processor configured to:

cause the recording medium to be supplied to the fuser after warming up the fuser to a warm up temperature;

supply power to the fuser after causing the recording medium to be supplied to the fuser, an amount of the supplied power being based on the temperature detected before starting the warming up;

vary an upper limit value of the supplied power based on the temperature detected before starting the warming up; and vary a lower limit value of the supplied power based on the temperature detected before starting the warming up.

2. The image forming apparatus of claim 1, wherein the processor is further configured to:

cause the power to be supplied to the fuser such that the supplied power is maintained at an upper limit value for a period of time; and vary the period of time based on a comparison of the temperature detected before starting the warming up to a first threshold.

3. The image forming apparatus of claim 1, wherein the processor is further configured to:

compare the temperature to a first threshold;

determine a change in the temperature;

compare the change to a second threshold; and cause the power to not be supplied to the fuser when the temperature is greater than the first threshold and the change is less than the second threshold.

4. The image forming apparatus of claim 1, wherein the processor is further configured to:

determine a type of the recording medium;

vary the upper limit value based on the temperature detected before starting the warming up and the type of the recording medium; and vary the lower limit value based on the temperature detected before starting the warming up and the type of the recording medium.

5. The image forming apparatus of claim 1, further comprising a second sensor configured to detect an environment temperature of an environment within which the image forming apparatus is located;

wherein the processor is further configured to:

vary the upper limit value based on the temperature detected before starting the warming up and the environment temperature; and vary the lower limit value based on the temperature detected before starting the warming up and the environment temperature.

6. The image forming apparatus of claim 2, wherein the processor is further configured to:

determine a type of the recording medium; and vary the period of time based on the type of the recording medium and the comparison of the temperature detected before starting the warming up to the first threshold.

7. The image forming apparatus of claim 2, further comprising a second sensor configured to detect an environment temperature of an environment within which the image forming apparatus is located;

wherein the processor is further configured to vary the period of time based on the environment temperature and the comparison of the temperature detected before starting the warming up to the first threshold.

8. The image forming apparatus of claim 1, wherein the fuser is an induction heating type fuser.

9. The image forming apparatus of claim 1, wherein:

the fuser comprises an endless fixing belt; and the first sensor is located inside the endless fixing belt and at a central portion of the endless fixing belt in a longitudinal direction.

10. An image forming apparatus comprising:
an image former configured to form an image on a recording medium;
a fuser configured to fix the image on the recording medium, the fuser comprising:
a roller;
a fixing belt disposed in confronting relation with the roller;
a first sensor disposed within the fixing belt and configured to detect a temperature of the fixing belt;
a frame disposed within the fixing belt; and
a pad coupled to the frame and configured to pinch the fixing belt with the roller;
a memory configured to populate a dataset by storing the temperature as a function of time; and
a processor configured to:
cause the recording medium to be supplied to the fuser after warming up the fuser to a warm up temperature; and
cause power to be supplied to the fuser based on the dataset, an amount of the power being based on the temperature detected before starting the warming up.

11. The image forming apparatus of claim 10, wherein the fuser further comprises:
an adjustor coupled to the frame;
an aligner coupled to the adjustor and disposed in confronting relation with the fixing belt; and
a coil separated from the aligner by the fixing belt.

12. The image forming apparatus of claim 11, wherein:
the processor is configured to energize the coil; and
the coil and the aligner are configured such that energizing of the coil causes displacement of the aligner relative to the frame.

13. The image forming apparatus of claim 12, wherein the fixing belt comprises:
a sleeve;
a first nickel layer;
a copper layer separated from the sleeve by the first nickel layer; and
a second nickel layer separated from the first nickel layer by the copper layer.

14. The image forming apparatus of claim 12, wherein the fuser further comprises a shield disposed between the aligner and the frame, the shield constructed from aluminum.

15. An image forming apparatus comprising:
an image former configured to form an image on a recording medium;
a fuser configured to fix the image on the recording medium;
a first sensor configured to detect a temperature of the fuser;
a memory configured to populate a dataset by storing the temperature as a function of time; and
a processor configured to:
cause the recording medium to be supplied to the fuser after warming up the fuser to a warm up temperature; and
cause power to be supplied to the fuser based on the temperature, an amount of the power being based on the temperature detected before starting the warming up;
compare the temperature to a first threshold;
compare the temperature to a previous temperature within the dataset to determine a change relative to the previous temperature;
compare the change to a second threshold; and
cause the power to not be supplied to the fuser when the temperature is greater than the first threshold and the change is less than the second threshold.

16. The image forming apparatus of claim 15, wherein the processor is further configured to:
select an upper limit value of the power supplied to the fuser based on the temperature detected before starting the warming up; and
select a lower limit value of the power supplied to the fuser based on the temperature detected before starting the warming up.

17. The image forming apparatus of claim 16, further comprising a second sensor configured to detect an environment temperature of an environment within which the image forming apparatus is located;
wherein the processor is further configured to:
select the upper limit value based on the temperature detected before starting the warming up and the environment temperature; and
select the lower limit value based on the temperature detected before starting the warming up and the environment temperature.

18. The image forming apparatus of claim 15, further comprising a second sensor configured to detect an environment temperature of an environment within which the image forming apparatus is located;
wherein the processor is further configured to:
cause the power to be supplied to the fuser such that the power is maintained at an upper limit value for a period of time; and
select the period of time based on a comparison of the temperature detected before starting the warming up to a third threshold; and
select the period of time based on the environment temperature detected before starting the warming up and the comparison of the temperature to the third threshold.

19. The image forming apparatus of claim 15, wherein the fuser comprises:
a roller;
a fixing belt disposed in confronting relation with the roller;
a frame disposed within the fixing belt;
a pad coupled to the frame and configured to bias the fixing belt towards the roller;
an adjustor coupled to the frame;
an aligner coupled to the adjustor and disposed in confronting relation with the fixing belt;
a coil separated from the aligner by the fixing belt; and
a shield disposed between the aligner and the frame, the shield constructed from aluminum.

* * * * *